US006439348B2

(12) United States Patent
Tajima et al.

(10) Patent No.: US 6,439,348 B2
(45) Date of Patent: Aug. 27, 2002

(54) ELEVATOR CONTROLLER CONTROLLING CHARGING OF A BATTERY POWER SOURCE WITH REGENERATIVE POWER

(75) Inventors: Shinobu Tajima; Hiroshi Araki; Ikuro Suga; Kazuyuki Kobayashi, all of Tokyo (JP)

(73) Assignees: Mitsubishi Denki Kabushiki Kaisha; The Tokyo Electric Power Company, Inc, both of Tokyo (JP)

( * ) Notice: Subject to any disclaimer, the term of this patent is extended or adjusted under 35 U.S.C. 154(b) by 0 days.

(21) Appl. No.: 09/778,876

(22) Filed: Feb. 8, 2001

(30) Foreign Application Priority Data

Feb. 28, 2000 (JP) ..... 2000-052343

(51) Int. Cl.[7] ..... B66B 1/06

(52) U.S. Cl. ..... 187/290; 187/296; 318/376

(58) Field of Search ..... 187/391, 296, 187/396, 290; 318/375, 376, 798–815; 320/106, 153, 150

(56) References Cited

U.S. PATENT DOCUMENTS 4,484,664 A * 11/1984 Nomura ..... 187/29 R
4,666,020 A * 5/1987 Watanabe ..... 187/114
5,698,823 A * 12/1997 Tanahashi ..... 187/296
6,315,081 B1 * 11/2001 Yeo ..... 187/290

FOREIGN PATENT DOCUMENTS

JP 10-67469 3/1998

OTHER PUBLICATIONS

U.S. patent application Ser. No. 09/741,159, Tajima et al., filed Dec. 21, 2000.
U.S. patent application Ser. No. 09/742,894, Tajima et al., filed Dec. 21, 2000.

* cited by examiner

*Primary Examiner*—Jonathan Salata
(74) *Attorney, Agent, or Firm*—Leydig Voit & Mayer, Ltd

(57) ABSTRACT

A controller of an elevator for stably controlling regenerated power by using a cheap secondary battery of a low capacity without damaging energy saving effects obtained by charging. The controller of the elevator includes a converter for rectifying AC power and converting the AC power to DC power; an inverter for converting the DC power to AC power having a variable voltage and a variable frequency and operating the elevator; a power accumulating device for accumulating DC power from a DC bus in a regenerative operation of the elevator and supplying the DC power accumulated on the DC bus during a power operation time; a charging-discharging control circuit for controlling charging and discharging operations of the power accumulating device; a series connecting body arranged between DC buses and including a gate for regenerative current control and a regenerative resistor; a regenerative control circuit for controlling operation of the gate for regenerative current control; and a charging-discharging state measuring device for measuring charge and discharge states of the power accumulating device. The regenerative control circuit controls the operation of the gate for regenerative current control in control modes in which duty is different in accordance with a measured value of the charge and discharge states.

8 Claims, 8 Drawing Sheets

| CHARGING CURRENT | CHARGING VOLTAGE | DUTY |
|---|---|---|
| 0 ~ I1 | V01<br>V02 | d01<br>d02 |
| ~ IL | V11<br>V12 | d11<br>d12 |
| ~ I3 | ⋮ | ⋮ |
| ⋮ | ⋮ | ⋮ |

FIG. 6

| CHARGING VOLTAGE | CHARGING AMOUNT OF CHARGING VOLTAGE | DUTY |
|---|---|---|
| ~ V0 | DV01<br>DV02 | d01<br>d02 |
| ~ V1 | DV11<br>DV12 | d11<br>d12 |
| ~ V2 | | |

T2

FIG. 7

| CHARGING VOLTAGE | CHARGING AMOUNT OF CHARGING VOLTAGE | DUTY |
|---|---|---|
| ~ V0 | DV01<br>DV02 | d01<br>d02 |
| ~ V1 | DV11<br>DV12 | d11<br>d12 |
| ~ V2 | | |

T2a
T2b
T2c

ELEVATOR CONTROLLER CONTROLLING CHARGING OF A BATTERY POWER SOURCE WITH REGENERATIVE POWER

BACKGROUND OF THE INVENTION

1. Field of the Invention

This invention relates to a controller of an elevator of an energy saving type to which a secondary battery is applied.

2. Description of the Related Art

FIG. 8 is a view showing the basic construction of a controller for controlling the operation of an elevator by applying a conventional secondary battery thereto.

In FIG. 8, reference numerals 1 and 2 respectively designate a three-phase AC power source and a converter constructed by a diode, etc. and converting AC power outputted from the three-phase AC power source 1 to DC power. The DC power converted by the converter 2 is supplied to a DC bus 3. The operation of an inverter 4 is controlled by a speed controller for controlling a speed position of the elevator and described later. A direct current supplied through the DC bus 3 is converted to an alternating current of predetermined desirable variable voltage and variable frequency and an AC motor 5 is driven so that a hoisting machine 6 of the elevator directly connected to the AC motor 5 is rotated. Thus, a rope 7 wound around the hoisting machine 6 controls elevating and lowering operations of a car 8 and a counterweight 9 connected to both ends of this rope 7 and passengers within the car 8 are moved to a predetermined stage floor.

Here, weights of the car 8 and the counterweight 9 are designed such that these weights are approximately equal to each other when passengers half a number limit ride in the car 8. Namely, when the car 8 is elevated and lowered with no load, a power running operation is performed at a lowering time of the car 8 and a regenerative operation is performed at a elevating time of the car 8. Conversely, when the car 8 is lowered in the number limit riding, the regenerative operation is performed at the lowering time of the car 8 and the power running operation is performed at the elevating time of the car 8.

An elevator control circuit 10 is constructed by a microcomputer, etc., and manages and controls an entire operation of the elevator. A power accumulating device 11 is arranged between DC buses 3 and accumulates power at the regenerative operation time of the elevator, and supplies the accumulated power to the inverter 4 together with the converter 2 at the power running operation time. The power accumulating device 11 is constructed by a secondary battery 12 and a DC-DC converter 13 for controlling charging and discharging operations of this secondary battery 12.

Here, the DC-DC converter 13 has a voltage lowering type chopper circuit and a voltage raising type chopper circuit. The voltage lowering type chopper circuit is constructed by a reactor 13*a*, a gate 13*b* for charging current control connected in series to this reactor 13*a*, and a diode 13*c* connected in reverse parallel to a gate 13*d* for discharging current control described later. The voltage raising type chopper circuit is constructed by the reactor 13*a*, the gate 13*d* for discharging current control connected in series to this reactor 13*a*, and a diode 13*e* connected in reverse parallel to the above gate 13*b* for charging current control. Operations of the gate 13*b* for charging current control and the gate 13*d* for discharging current control are controlled by a charging-discharging control circuit 15 on the basis of a measuring value from a charging-discharging state measuring device 14 for measuring charging and discharging states of the power accumulating device 11 and a measuring value from a voltage measuring instrument 18. A current measuring instrument arranged between the secondary battery 12 and the DC-DC converter 13 is used as the charging-discharging state measuring device 14 in this conventional example.

A gate 16 for regenerative current control and a regenerative resistor 17 are arranged between DC buses 3. The voltage measuring instrument 18 measures the voltage of a DC bus 3. A regenerative control circuit 19 is operated on the basis of regenerative control commands from a speed control circuit described later. The gate 16 for regenerative current control is constructed such that an ON pulse width is controlled on the basis of control of the regenerative control circuit 19 when a measuring voltage provided by the voltage measuring instrument 17 is equal to or greater than a predetermined value at the regenerative operation time. Regenerated power is discharged in the regenerative resistor 17 and is converted to thermal energy and is consumed.

An encoder 20 is directly connected to the hoisting machine 6. The speed control circuit 21 controls a position and a speed of the elevator by controlling an output voltage and an output frequency of the inverter 4 on the basis of speed commands and a speed feedback output from the encoder 22 based on commands from the elevator control circuit 10.

An operation of the controller having the above construction will next be explained.

At a power running operation time of the elevator, power is supplied to the inverter 4 from both the three-phase AC power source 1 and the power accumulating device 11. The power accumulating device 11 is constructed by the secondary battery 12 and the DC-DC converter 13, and an operation of this power accumulating device 11 is controlled by the charging-discharging control circuit 15. In general, the number of secondary batteries 12 is reduced as much as possible and an output voltage of each secondary battery 12 is lower than the voltage of the DC bus 3 so as to make the controller compact and cheaply construct the controller. The voltage of the DC bus 3 is basically controlled near a voltage provided by rectifying a three-phase AC of the three-phase AC power source 1. Accordingly, it is necessary to lower the bus voltage of the DC bus 3 at a charging time of the secondary battery 12 and raise the bus voltage of the DC bus 3 at a discharging time of the secondary battery 12. Therefore, the DC-DC converter 13 is adopted. Operations of the gate 13*b* for charging current control and the gate 13*d* for discharging current control in this DC-DC converter 13 are controlled by the charging-discharging control circuit 15.

FIGS. 9 and 10 are flow charts showing controls of the charging-discharging control circuit 15 at its discharging and charging times.

The control of the charging-discharging control circuit 15 at the discharging time shown in FIG. 9 will first be explained.

A current control minor loop, etc. are constructed in voltage control of a control system and the control operation may be more stably performed. However, for simplicity, the control of the charging-discharging control circuit 15 is here explained by a control system using the bus voltage.

First, the bus voltage of the DC bus 3 is measured by the voltage measuring instrument 17 (step S11). The charging-discharging control circuit 15 compares this measuring voltage with a predetermined desirable voltage set value and judges whether the measuring voltage exceeds the voltage set value or not (step S12). If no measuring voltage exceeds the set value, the charging-discharging control circuit 15 next judges whether the measuring value of a discharging current of the secondary battery 12 provided by the charging-discharging state measuring device 14 exceeds a predetermined value or not (step S13).

When the measuring voltage exceeds the set value by these judgments, or when the measuring value of the discharging current of the secondary battery 12 exceeds the predetermined value even if no measuring voltage exceeds the set value, an adjusting time DT is subtracted from the present ON time to shorten an ON pulse width of the gate 13*d* for discharging current control and a new gate ON time is calculated (step S14).

In contrast to this, when it is judged in the above step S13 that no measuring value of the discharging current of the secondary battery 12 provided by the measuring device 14 exceeds the predetermined value, a new gate ON time is calculated by adding the adjusting time DT to the present ON time so as to lengthen the ON pulse width of the gate 13*d* for discharging current control (step S15). Thus, ON control of the gate 13*d* for discharging current control is performed on the basis of the calculated gate ON time, and the calculated gate ON time is stored to a built-in memory as the present ON time (step S16).

Thus, more electric current flows from the secondary battery 12 by lengthening the ON pulse width of the gate 13*d* for discharging current control. As a result, supply power is increased and the bus voltage of the DC bus 3 is increased by the power supplied. When the power running operation is considered, the elevator requires power and this power is supplied by discharging the secondary battery 12 and by power from the three-phase AC power source 1. When the bus voltage is controlled such that this bus voltage is higher than an output voltage of the converter 2 supplied from the three-phase AC power source 1, all power is supplied from the secondary battery 12. However, the controller is designed such that all power is not supplied from the secondary battery 12, but is supplied from the secondary battery 12 and the three-phase AC power source 1 in a suitable ratio to cheaply construct the power accumulating device 11.

Namely, in FIG. 9, the measuring value of the discharging current is compared with a supply allotment corresponding current (predetermined value). If this measuring value exceeds the predetermined value, the ON pulse width of the gate 13*d* for discharging current control is lengthened and a supply amount is further increased. In contrast to this, when no measuring value of the discharging current exceeds the predetermined value, the ON pulse width of the gate 13*d* for discharging current control is shortened and the power supply is clipped. Thus, since power supplied from the secondary battery 12 is clipped from the power required in the inverter 4, -the bus voltage of the DC bus 3 is reduced so that supply of power from the converter 2 is started. These operations are performed for a very short time so that a suitable bus voltage is actually obtained to supply required power of the elevator. Thus, power can be supplied from the secondary battery 12 and the three-phase AC power source 1 in a predetermined desirable ratio.

The control of the charging-discharging control circuit 15 at the charging time shown in FIG. 10 will next be explained.

When there is power regeneration from the AC motor 5, the bus voltage of the DC bus 3 is increased by this regenerated power. When this voltage is higher than an output voltage of the converter 2, the power supply from the three-phase AC power source 1 is stopped. When there is no power accumulating device 11 and this stopping state is continued, the voltage of the DC bus 3 is increased. Therefore, when a measuring voltage value of the voltage measuring instrument 17 for detecting the bus voltage of the DC bus 3 reaches a certain predetermined voltage, the regenerative control circuit 19 is operated and closes the gate 16 for regenerative current control. Thus, power flows through the regenerative resistor 17 and the regenerated power is consumed and the elevator is decelerated by electromagnetic braking effects. However, when there is the power accumulating device 11, this power is sent to the power accumulating device 11 by the control of the charging-discharging control circuit 15 with a voltage equal to or smaller than a predetermined voltage.

Namely, as shown in FIG. 10, if the measuring value of the bus voltage of the DC bus 3 provided by the voltage measuring instrument 17 exceeds the predetermined voltage, the charging-discharging control circuit 15 detects that it is a regenerative state, and increases a charging current to the secondary battery 12 by lengthening the ON pulse width of the gate 13*b* for charging current control (step S21→S22→S23). When the regenerated power from the elevator is reduced in a short time, the voltage of the DC bus 3 is also correspondingly reduced and no measuring value of the voltage measuring instrument 17 exceeds the predetermined voltage. Accordingly, the ON pulse width of the gate 13*b* for charging current control is shortly controlled and charging power is also reduced and controlled (step S21→S22→S24).

Thus, the bus voltage is controlled in a suitable range and a charging operation is performed by monitoring the bus voltage of the DC bus 3 and controlling the charging power. Further, energy is saved by accumulating and re-utilizing power conventionally consumed in the regenerated power. When no power of a charger is consumed for certain reasons, such as a breakdown, etc., the regenerative control circuit 19 is operated as a backup and the regenerated power is consumed by a resistor so that the elevator is suitably decelerated. In a general elevator for housing, the regenerated power is about 2 KVA and is about 4 KVA at its maximum decelerating value, although this regenerated power varies in accordance with capacity of the elevator, etc.

The regenerative control circuit 19 monitors the voltage of the DC bus 3. If this voltage is equal to or greater than a predetermined value, the ON pulse width of the gate 16 for regenerative current control is controlled by the regenerative control circuit 19 so as to discharge the power in the regenerative resistor 17, so that the regenerated power flows through the regenerative resistor 17. There are various kinds of systems for controlling this pulse width, but the pulse width is simply controlled in accordance with the following formula. Namely, when the voltage of the DC bus 3 for starting turning-on of the gate 16 for regenerative current control is set to VR, a flowing current IR can be simply calculated by turning-on (closing) a circuit since the resistance of the regenerative resistor 17 is already known. Further, maximum power flow is already known. Therefore, if this maximum power (VA) is set to WR, it is sufficient to generate an ON pulse with a duty of WR/(VR×IR) while the DC bus voltage is monitored. However, an object of this construction is to consume all regenerated power in the regenerative resistor 17.

However, in the conventional controller of the elevator, it is necessary to use the secondary battery 12 having a large capacity and able to be charged by the regenerated power, in the power accumulating device 11, for all conditions, in which a temperature and charging degree of the power accumulating device 11, i.e., a full charging state of the power accumulating device 11, are set to reference values and a product of a charging-discharging current and a charging-discharging voltage is normalized and accumulated as a capacity, and a SOC (State Of Charge) is obtained as this normalized and accumulated value, etc. Therefore, an expensive and large sized power accumulating device 11 is required.

SUMMARY OF THE INVENTION

To solve the above-mentioned problems, an object of the present invention is to provide a controller of an elevator capable of stably controlling regenerated power by using a cheap secondary battery of a low capacity without damaging energy saving effects obtained by charging.

To achieve this object, a controller of an elevator in this invention comprises a converter for rectifying AC power from an AC power source and converting the AC power to DC power; an inverter for converting the DC power to AC power of a variable voltage and a variable frequency and driving an electric motor and operating the elevator; power accumulating means arranged between DC buses between the converter and the inverter, and accumulating DC power from the DC buses at a regenerative operation time of the elevator and supplying the DC power accumulated on the DC buses at a power running operation time; charging-discharging control means for controlling charging and discharging operations of the power accumulating means with respect to the DC buses; a series connecting body arranged between the DC buses and constructed by a gate for regenerative current control and a regenerative resistor for discharging regenerated power flowing-in through this gate for regenerative current control; regenerative control means for controlling an operation of the gate for regenerative current control; and charging-discharging state measuring means for measuring charging and discharging states of the power accumulating means; the regenerative control means controlling the operation of the gate for regenerative current control in plural control modes in which an electric current or power flowing through the regenerative resistor is different in accordance with a measuring value from the charging-discharging state measuring means.

Further, the charging-discharging state measuring means includes bus voltage measuring means for measuring a bus voltage of each of the DC buses, and a measuring value of the bus voltage is outputted as a measuring value of the charging and discharging states, and the regenerative control means controls an ON pulse of the gate for regenerative current control in accordance with the measuring value of the bus voltage.

Further, the charging-discharging state measuring means further comprises charging voltage measuring means for measuring a charging voltage of the power accumulating means, and the regenerative control means controls the ON pulse of the gate for regenerative current control in accordance with the measuring value of the bus voltage and a measuring value of the charging voltage.

Further, the charging-discharging state measuring means measures at least one of charging and discharging currents, charging and discharging voltages and a temperature of the power accumulating means, and the regenerative control means has a table setting duty therein in accordance with these measuring values, and an ON pulse of the gate for regenerative current control is controlled in accordance with the duty set in the table.

Further, the regenerative control means has a table setting duty therein in accordance with the charging current and the charging voltage.

Further, the regenerative control means has plural tables according to temperatures, and selects a table according to a measuring temperature from the charging-discharging state measuring means, and controls the ON pulse of the gate for regenerative current control in accordance with the duty according to the charging current and the charging voltage.

Further, the regenerative control means has a table setting duty therein in accordance with the charging voltage and a changing amount of the charging voltage.

Further, the regenerative control means has plural tables each according to a charging degree as a value obtained by normalizing and accumulating a product of a charging-discharging current by a charging-discharging voltage in a capacity with a full charging state of the power accumulating means as a reference, and selects a table according to the charging degree, and controls the ON pulse of the gate for regenerative current control in accordance with the duty according to the charging voltage and the changing amount of the charging voltage.

BRIEF DESCRIPTION OF THE DRAWINGS

FIG. 6 is an explanatory view of a table arranged in the regenerative control circuit in an embodiment of this invention in which duty is set in the table in accordance with the charging voltage and a changing amount of the charging voltage.

FIG. 7 is an explanatory view of plural tables arranged in the regenerative control circuit in an embodiment of this invention in which duty according to a charging degree SOC is set in the tables in accordance with the charging voltage and the changing amount of the charging voltage.

DESCRIPTION OF THE PREFERRED EMBODIMENTS

In this invention, a cheap secondary battery of a low capacity is used as a secondary battery for a power accumulating device, and a control operation is performed such that regenerated power can be stably controlled without damaging energy saving effects obtained by charging.

Characteristics of the secondary battery used in the power accumulating device are different from each other in accordance with kinds of the battery such as a lead battery, a nickel hydrogen battery, etc. However, in general, no charging operation is efficiently performed in relation to a solvent within the battery in states in which temperature is lower and higher than a normal temperature. Further, when a charging degree is high (approaches a full charge), no charging operation is efficiently performed. When a large electric current is charged in such bad charging reception states, an increase in internal resistance, i.e., increases in heating of the battery and charging voltage are caused and subsequent charging performance is further deteriorated. Therefore, it is necessary to control an operation of the secondary battery so as not to excessively charge the secondary battery as much as possible.

Figure 1:
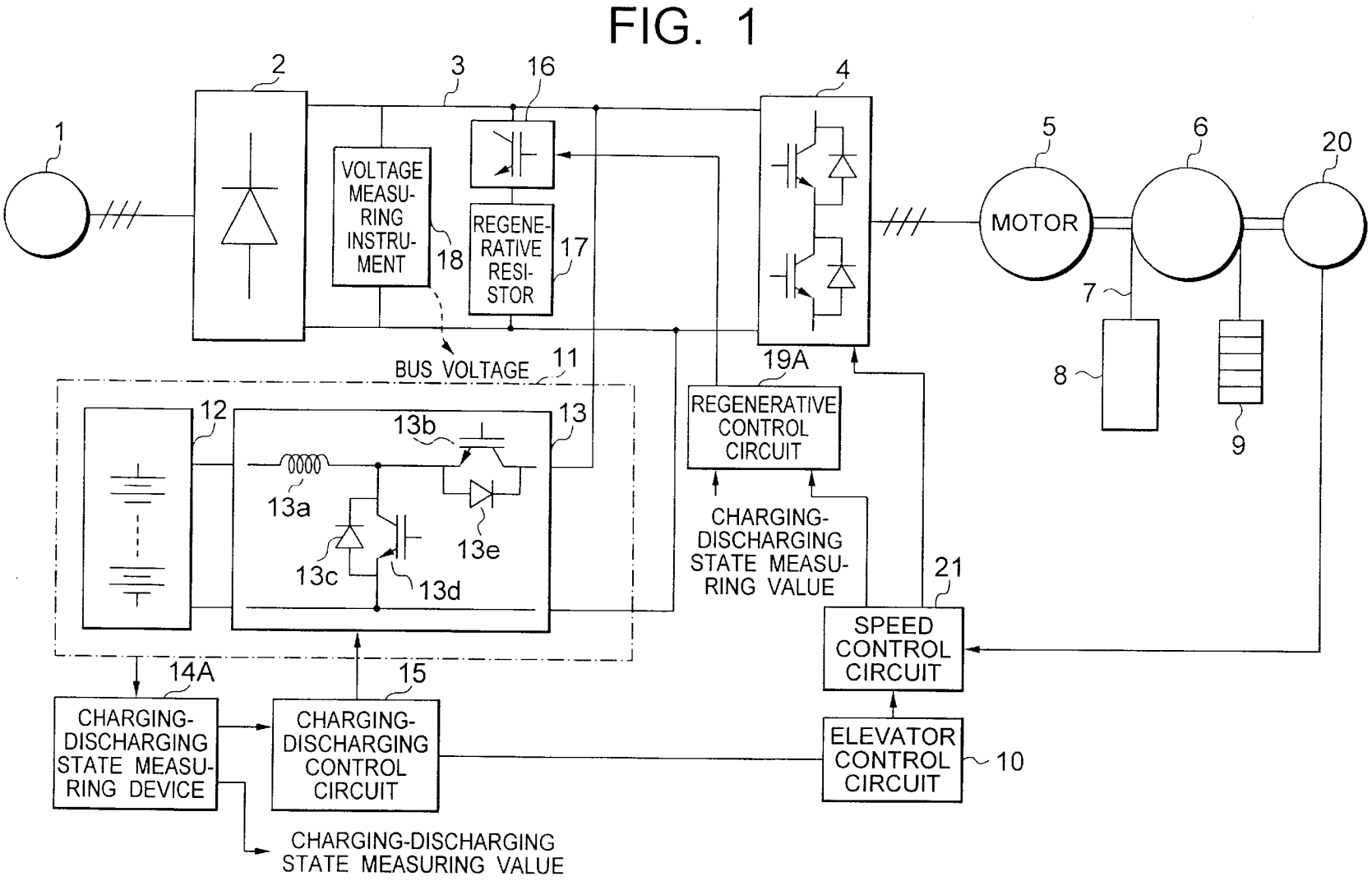
FIG. 1 is a block diagram showing the construction of a controller of an elevator in this invention.
Figure 8:
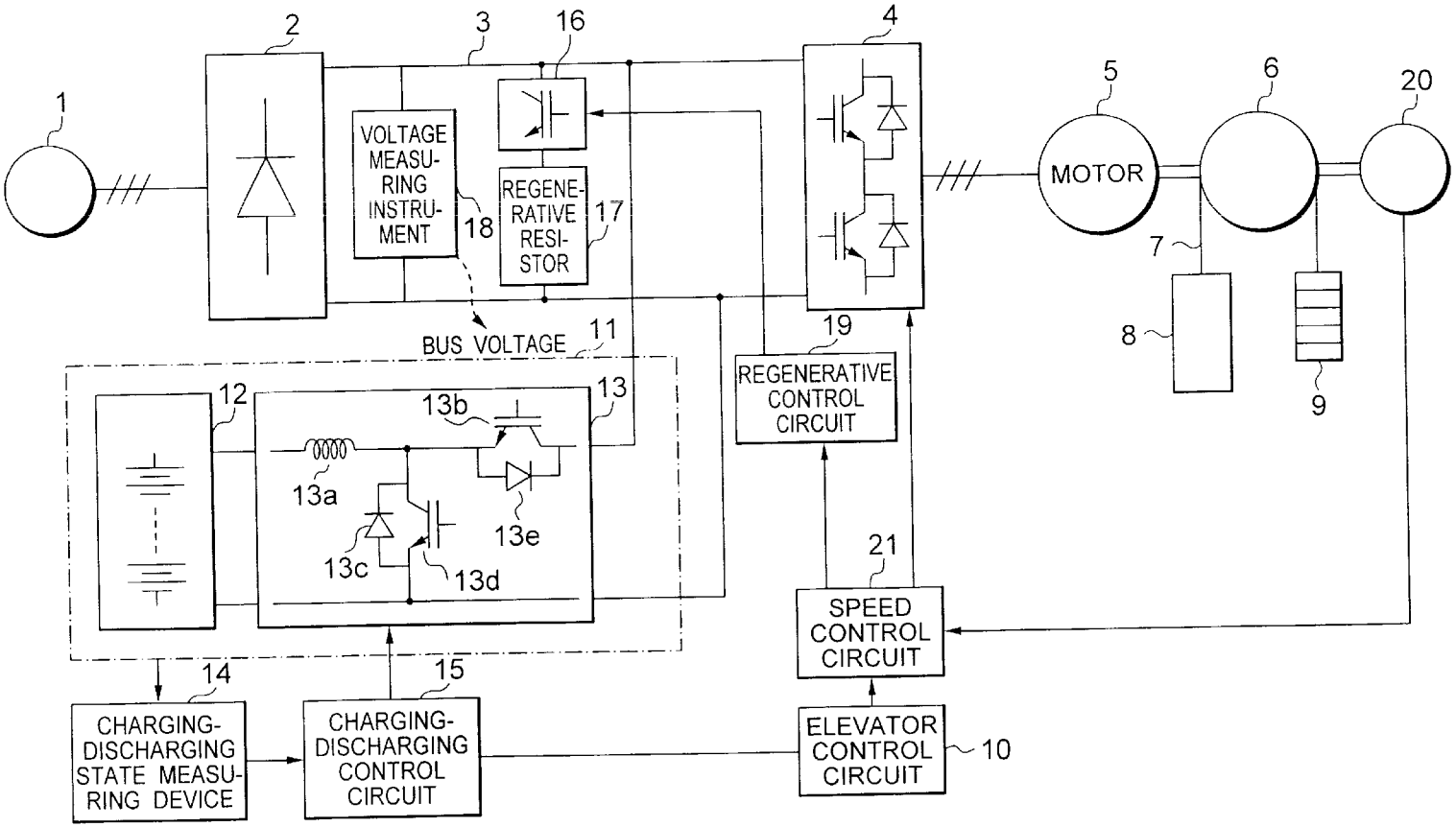
FIG. 8 is a block diagram showing the construction of a controlled of an elevator in a conventional example.
Figure 9:
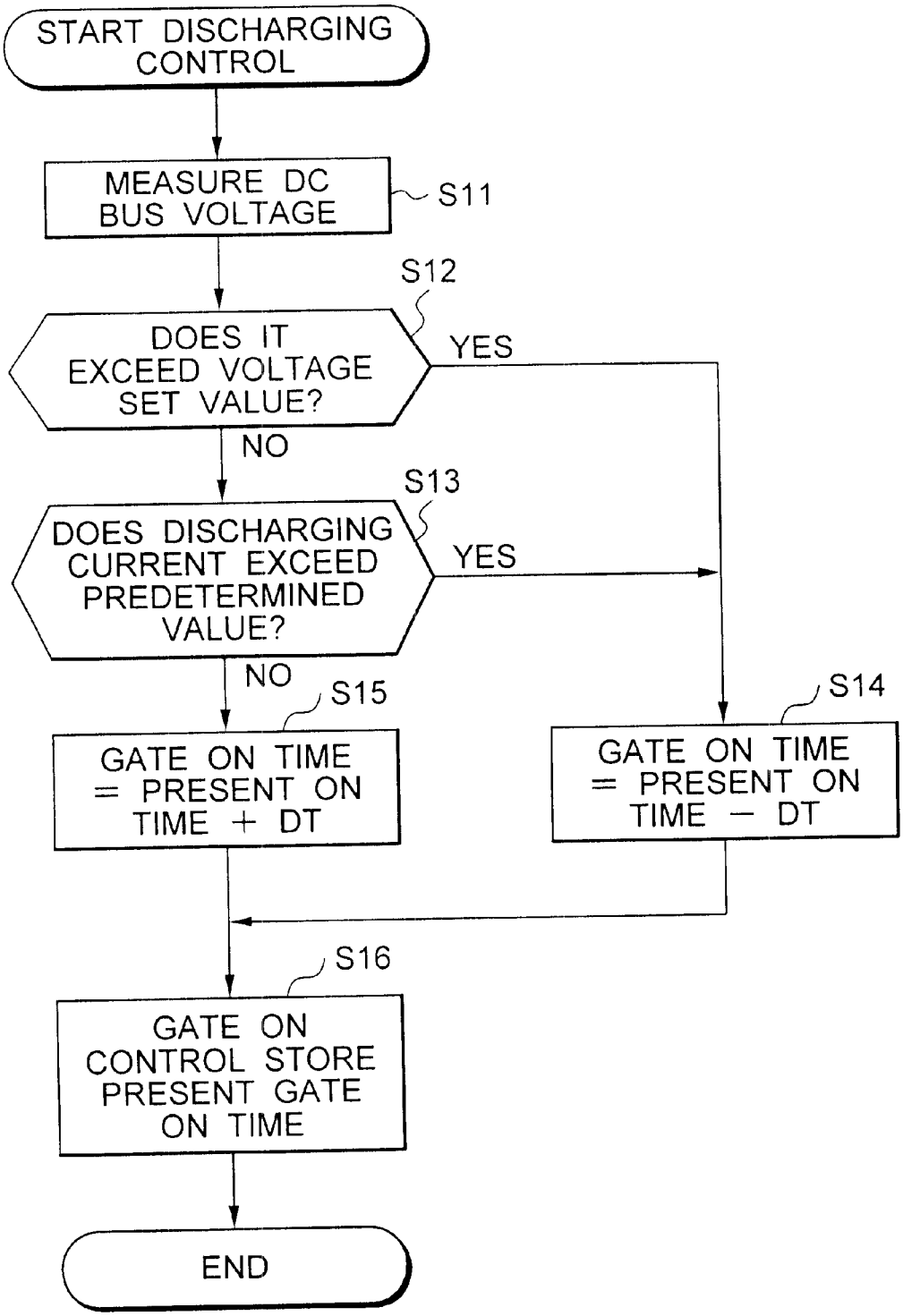
FIG. 9 is a flow chart showing the control of a charging-discharging control circuit shown in FIG. 8 at its discharging time.
Figure 10:
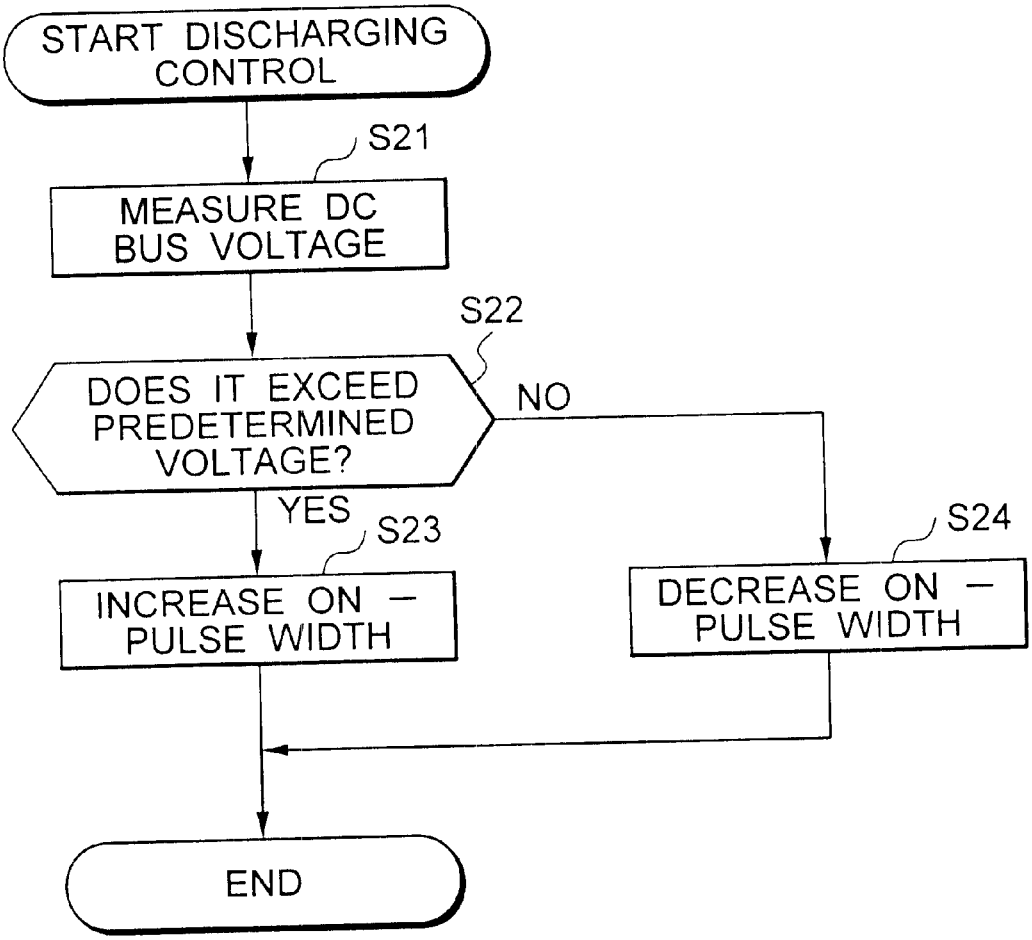
FIG. 10 is a flow chart showing the control of the charging-discharging control circuit shown in FIG. 8 at its charging time.

FIG. 1 is a block diagram showing the construction of a controller of an elevator in this invention. In FIG. 1, the same reference numerals as the conventional example shown in FIG. 8 are designated by the same reference numerals and their explanations are omitted here. New reference numerals 14A and 19 A respectively designate a charging-discharging state measuring device and a regenerative control circuit in the present invention. The regenerative control circuit 19A controls the operation of a gate 16 for regenerative current control in plural control modes in which an electric current or power flowing through a regenerative resistor is different in accordance with a measuring value from the charging-discharging state measuring device 14A.

Concrete embodiment modes will next be explained.

Embodiment mode 1

In this embodiment mode 1, the charging-discharging state measuring device 14A is separately shown in FIG. 1. However, the charging-discharging state measuring device 14A includes a voltage measuring instrument 18 for measuring a bus voltage of a DC bus 3, and considers a measuring value of this bus voltage as a charging-discharging state measuring value and outputs this measuring value to the regenerative control circuit 19A. The regenerative control circuit 19A controls the operation of the gate 16 for regenerative current control in plural control modes in which an electric current or power flowing through a regenerative resistor is different in accordance with the measuring value of the bus voltage.

Figure 2:
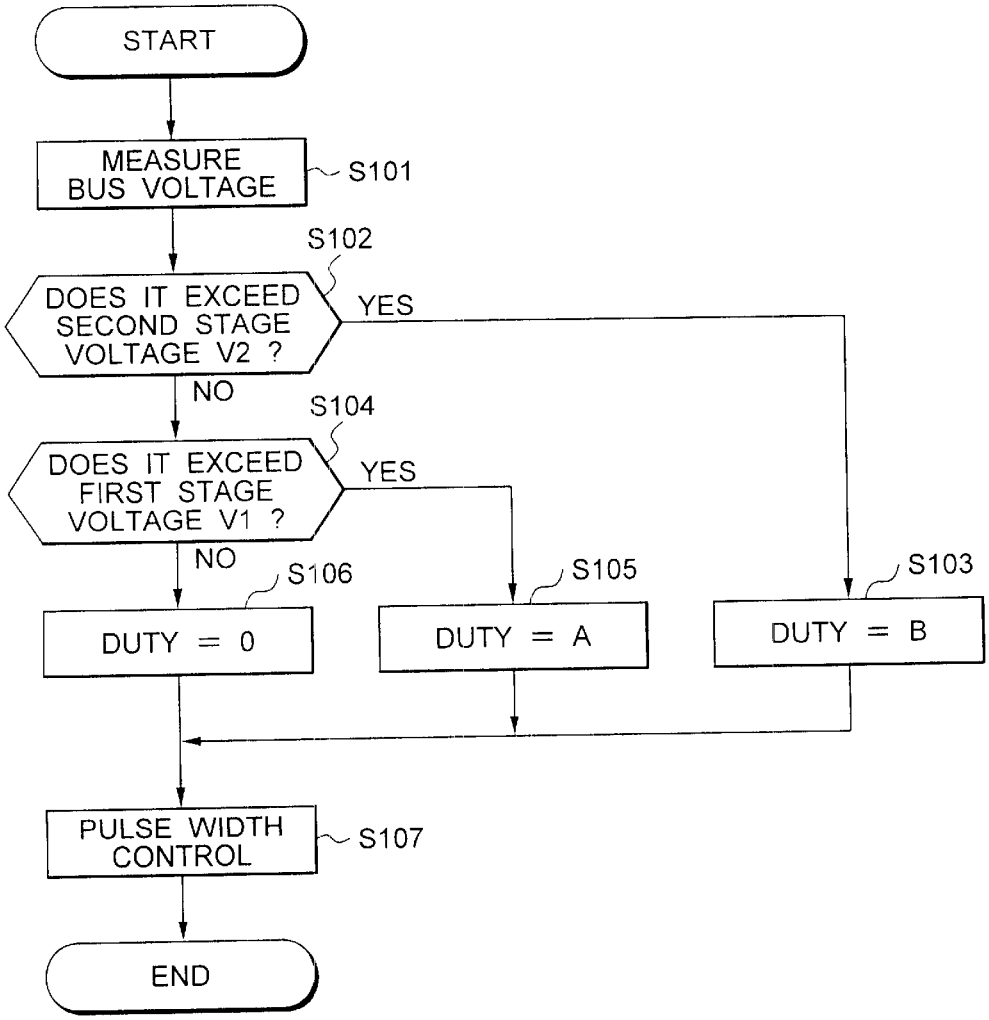
FIG. 2 is a flow chart showing control contents of a regenerative control circuit in an embodiment of this invention.

The control of the regenerative control circuit 19A in the embodiment mode 1 of this invention will next be explained with reference to the flow chart shown in FIG. 2.

The regenerative control circuit 19A determines an ON pulse width of the gate 16 for regenerative current control by the bus voltage of the DC bus 3. It is first judged whether the measured bus voltage exceeds a second stage voltage V2 or not (steps S101, S102). Here, the second stage voltage V2 is set to suppose that there is abnormality at a charging time, etc. The second stage voltage V2 is a voltage for performing a monitoring operation for flowing all regenerated power through the regenerative resistor 17. If the measured bus voltage exceeds this second stage voltage V2, duty of the ON pulse of the gate 16 for regenerative current control is set to B and a state for flowing all power through the regenerative resistor 17 is attained as in the conventional case (step S102→S103).

In contrast to this, when no measured bus voltage exceeds the second stage voltage V2, it is next judged whether the bus voltage exceeds a first stage voltage V1 or not (step S102→S104). Here, the first stage voltage V1 is lower than the above second stage voltage V2 and is higher than a voltage for starting charging of the power accumulating device 11 and is set in a regenerative charging state. If the bus voltage exceeds this voltage V1, the duty is set to A (step S104→S105). Here, for example, A is set such that the duty in A is set to ½ to ⅓ times the duty in B and regenerated power ½ to ⅓ times the regenerated power in B flows through the regenerative resistor 17. In contrast to this, if no bus voltage exceeds the voltage V1, the duty is set to 0 (step S104→S106). The width of the ON pulse of the gate 16 for regenerative current control is controlled in accordance with such a set duty (step S107).

Namely, when a regenerative operation is started, the bus voltage is increased and a charging-discharging control circuit 15 detects this increase and starts charging. If there are limits in a charging current, etc. and all power cannot be charged, the bus voltage 3 gradually begins to be increased and reaches the first stage voltage V1. Regenerated power is divided into powers in the above charging and regenerative resistance discharging from this time point. As a result, the regenerative operation is terminated without reaching the second stage voltage V2 unless there is abnormality in a charging circuit, etc.

Accordingly, in the controller of the elevator having such a construction, no excessive burden is applied to the secondary battery 12 when the regenerated power is charged to the power accumulating device 11. Therefore, a cheap power accumulating device having high energy saving efficiency can be used. Accordingly, it is possible to provide a controller of an elevator able to stably control the regenerated power by using a cheap secondary battery of a low capacity without damaging energy saving effects provided by charging.

Embodiment mode 2

In this embodiment mode 2, the charging-discharging state measuring device 14A shown in FIG. 1 further includes a charging voltage measuring instrument for measuring a charging voltage of the secondary battery 12 of the power accumulating device 11 with respect to the embodiment mode 1. A measuring value of the bus voltage and a measuring value of the charging voltage are outputted to the regenerative control circuit 19A as a measuring value in a charging-discharging state. The regenerative control circuit 19A controls the ON pulse width of the gate 16 for regenerative current control in accordance with the measuring value of the bus voltage and the measuring value of the charging voltage.

Namely, the voltage of the secondary battery 12 at the charging time is different in accordance with the present SOC state, a circumferential temperature, etc. even when the secondary battery 12 is charged by the same electric current. Further, it is not preferable to unconditionally limit the charging by only the voltage at the charging time. However, in charging control, it is necessary to monitor this charging voltage and limit a charging amount (power, electric current). In this embodiment mode 2, a control operation is performed in consideration of such points.

Figure 3:
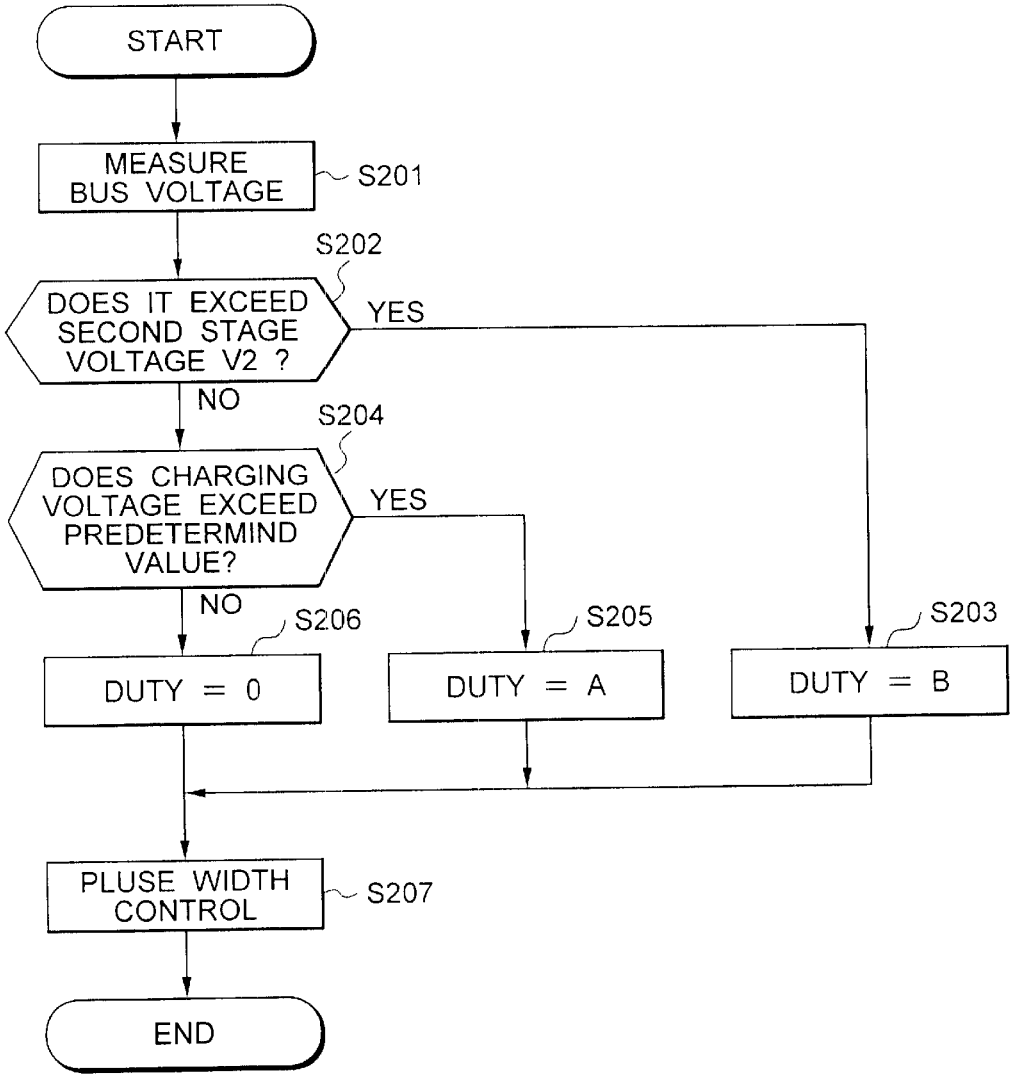
FIG. 3 is a flow chart showing control contents of the regenerative control circuit in an embodiment of this invention.

The control of the regenerative control circuit 19A in the embodiment mode 2 of this invention will next be explained with reference to the flow chart shown in FIG. 3.

Similar to the embodiment mode 1, the regenerative control circuit 19A, first, judges whether a measured bus voltage exceeds a second stage voltage V2 or not. When the measured bus voltage exceeds the second stage voltage V2, the regenerative control circuit 19A sets the duty of an ON pulse of the gate 16 for regenerative current control to B. Similar to the conventional case, a state for flowing all power through the regenerative resistor 17 is attained (steps S201 to S203).

In contrast to this, when no measured bus voltage exceeds the second stage voltage V2, it is next judged whether the charging voltage of the secondary battery 12 exceeds a predetermined value or not. If the charging voltage exceeds the predetermined value, duty=A is set as in the embodiment mode 1 (step S204→S205), and regenerated power ½ to ⅓ times that in B flows through the regenerative resistor 17. In contrast to this, if no charging voltage exceeds the predetermined value, the duty is set to 0 (step S204→S206). The width of the ON pulse of the gate 16 for regenerative current control is controlled in accordance with such a set duty (step S207).

Here, the predetermined value compared with the charging voltage is a value for performing a monitoring operation for protecting the battery at a charging time. When the charging voltage exceeds the predetermined value, excessive charging can be prevented by allotting one portion of the regenerated power to discharging using the regenerative resistor 17. Further, the regenerated power is charged as much as possible and the secondary battery 12 can be protected while energy saving efficiency is secured as a whole. Accordingly, a cheap power accumulating device can be constructed.

In each of the following embodiment modes, the charging-discharging state measuring device 14A shown in FIG. 1 has each of measuring instruments for measuring charging and discharging currents, charging and discharging voltages and a temperature of the power accumulating device 11. The regenerative control circuit 19A has a table in which these measuring values are inputted as charging-discharging state measuring values and duty according to each of the measuring values is set. The regenerative control circuit 19A controls the width of an ON pulse of the gate 16 for regenerative current control in accordance with the duty set in the table.

In general, a charging voltage of the power accumulating device 11 tends to be suddenly increased just before excessive charging even when the same amount of the charging current continuously flows through the power accumulating device 11. Accordingly, if a change in the charging voltage is measured, it is possible to perform a control operation in which charging is reduced and stopped, etc. at an early point in time. It is preferable in view of a battery life, etc. that no large charging is performed at a temperature except for a normal temperature. If the control operation is performed in fine conditions of a change in the charging voltage, SOC, temperature, etc. as well as the charging voltage, this control operation has a preferable influence on the life of the secondary battery 12 and it is more effective that these tables are made and the regenerative control is performed in plural modes.

Namely, the change in the charging voltage provided by charging is strictly caused by charging results. If a table for restraining an electric current is provided by temperature and SOC, the control operation can be clearly performed in further detail. The regenerated power is received as much as possible in the charging to the power accumulating device 11 to secure energy saving effects, but the control operation is performed such that no secondary battery 12 is excessively charged to protect its charging ability and secure the battery life.

Each of embodiment modes having a table and controlling the ON pulse width of the gate 16 for regenerative current control in accordance with duty set in the table will next be described.

Embodiment mode 3

Figures 4, 5:
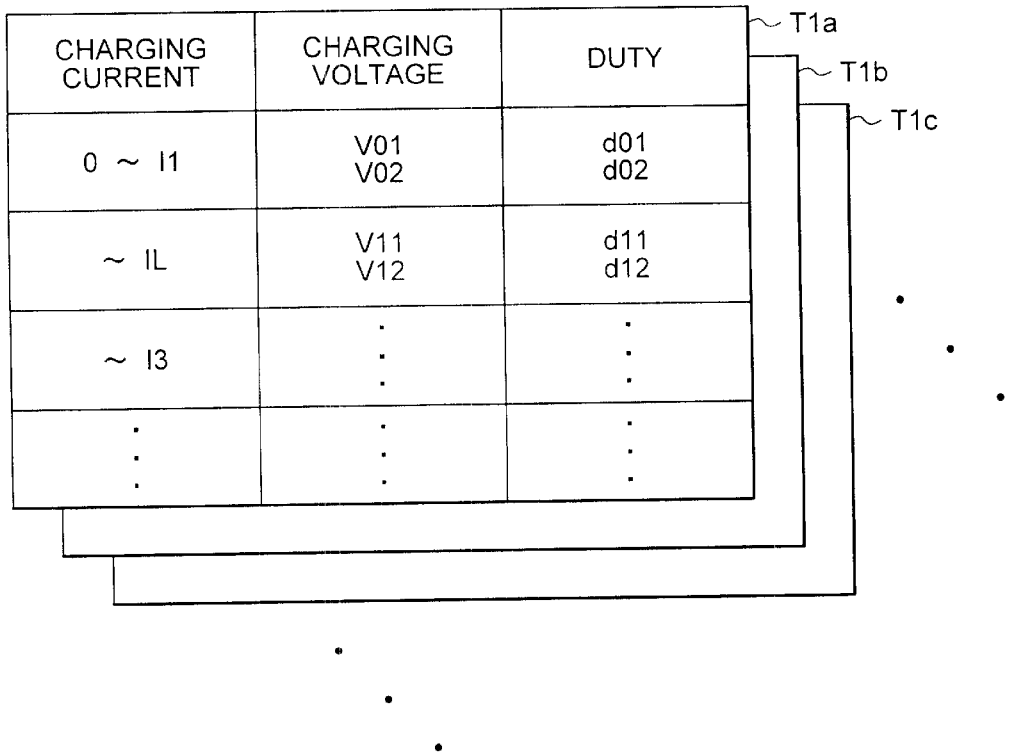
FIG. 4 is an explanatory view of a table arranged in the regenerative control circuit in an embodiment of this invention in which duty is set in the table in accordance with a charging current and a charging voltage.
FIG. 5 is an explanatory view of plural tables arranged in the regenerative control circuit in an embodiment of this invention in which duty according to temperature is set in the tables in accordance with the charging current and the charging voltage.

As shown in FIG. 4, the regenerative control circuit 19A has a table Ti setting duty therein in accordance with a charging current and a charging voltage. Duty corresponding to measuring values of the charging current and the charging voltage is calculated from the table Ti. The ON pulse width of the gate 16 for regenerative current control is controlled in accordance with this duty.

Embodiment mode 4

As shown in FIG. 5, the regenerative control circuit 19A has plural tables T1*a*, T1*b*, T1*c*, - - - in which duty according to the temperature of the secondary battery 12 is set in accordance with the charging current and the charging voltage.

The regenerative control circuit 19A selects a table according to the measuring temperature from these tables, and controls the ON pulse width of the gate 16 for regenerative current control in accordance with the duty set in the selected table.

Embodiment mode 5

As shown in FIG. 6, the regenerative control circuit 19A has a table T2 in which duty is set in accordance with the charging voltage and a changing amount of the charging voltage. The regenerative control circuit 19A calculates duty set in the table T3 on the basis of the charging voltage and the changing amount of the charging voltage, and controls the ON pulse width of the gate 16 for regenerative current control in accordance with the calculated duty.

Embodiment mode 6

As shown in FIG. 7, the regenerative control circuit 19A has plural tables T2*a*, T2*b*, T2*c*, - - - in which duty according to a charging degree SOC is set in accordance with the charging voltage and a changing amount of the charging voltage. The regenerative control circuit 19A selects a table according to this charging degree SOC, and calculates duty set in the selected table on the basis of the charging voltage and the changing amount of the charging voltage. The regenerative control circuit 19A then controls the ON pulse of the above gate for regenerative current control in accordance with the calculated duty.

As mentioned above, according to this invention, the operation of the gate for regenerative current control is controlled in plural control modes in which an electric current or power flowing through the regenerative resistor is different in accordance with a charging state of the power accumulating device. Accordingly, it is possible to stably control the regenerated power by using a cheap secondary battery of a low capacity without damaging energy saving effects provided by charging.

What is claimed is:

1. A controller of an elevator comprising:

a converter for rectifying AC power from an AC power source and converting the AC power to DC power;

an inverter for converting the DC power to AC power having a variable voltage and a variable frequency and driving an electric motor operating an elevator;

power accumulating means arranged between DC buses of said converter and said inverter, and accumulating DC power from the DC buses during a regenerative operation of the elevator and supplying the DC power accumulated to the DC buses during a power operation time;

charging-discharging control means for controlling charging and discharging operations of said power accumulating means with respect to said DC buses;

a series connecting body arranged between said DC buses and including a gate for regenerative current control and a regenerative resistor for discharging regenerated power flowing in through said gate for regenerative current control;

regenerative control means for controlling operation of said gate for regenerative current control; and charging-discharging state measuring means for measuring charge and discharge states of said power accumulating means, said regenerative control means controlling operation of said gate for regenerative current control in plural control modes in which an electric current or power flowing through said regenerative resistor is different in accordance with a value measured by said charging-discharging state measuring means.

2. The controller of an elevator as claimed in claim 1, wherein said charging-discharging state measuring means includes bus voltage measuring means for measuring bus voltage of each of said DC buses, and the bus voltages measured are outputted as a measured value of the charging and discharging states, and said regenerative control means controls an ON pulse of said gate for regenerative current control in accordance with the bus voltages measured.

3. The controller of an elevator as claimed in claim 2, wherein said charging-discharging state measuring means further comprises charging voltage measuring means for measuring a charging voltage of said power accumulating means, and said regenerative control means controls the ON pulse of said gate for regenerative current control in accordance with the bus voltages measured and the charging voltage measured.

4. The controller of an elevator as claimed in claim 1, wherein said charging-discharging state measuring means measures at least one of charging and discharging currents, charging and discharging voltages, and a temperature of said power accumulating means, and said regenerative control means has a table setting duty in accordance with measured charging and discharging currents, charging and discharging voltages, and temperature, and an ON pulse of said gate for regenerative current control is controlled in accordance with the duty set in the table.

5. The controller of an elevator as claimed in claim 4, wherein said regenerative control means has a table setting duty in accordance with the charging current and the charging voltage.

6. The controller of an elevator as claimed in claim 5, wherein said regenerative control means has plural tables according to temperature, and selects a table according to a temperature measured by said charging-discharging state measuring means, and controls the ON pulse of said gate for regenerative current control in accordance with the duty according to the charging current and the charging voltage.

7. The controller of an elevator as claimed in claim 4, wherein said regenerative control means has a table setting duty in accordance with the charging voltage and change of the charging voltage.

8. The controller of an elevator as claimed in claim 7, wherein said regenerative control means has plural tables according to a charging degree obtained by normalizing and accumulating a product of a charging discharging current and a charging-discharging voltage in a full charging state of said power accumulating means as a reference, and selects a table according to the charging degree, and controls the ON pulse of said gate for regenerative current control in accordance with the duty according to the charging voltage and the change of the charging voltage.

* * * * *